United States Patent [19]

Bohan, Jr.

[11] 4,373,898

[45] Feb. 15, 1983

[54] TIMER AND CONTROL CIRCUIT

[75] Inventor: John E. Bohan, Jr., Minneapolis, Minn.

[73] Assignee: Honeywell Inc., Minneapolis, Minn.

[21] Appl. No.: 243,271

[22] Filed: Mar. 13, 1981

[51] Int. Cl.[3] ..... F23N 5/00

[52] U.S. Cl. ..... 431/73; 307/605; 431/6

[58] Field of Search ..... 431/31, 6, 69, 73; 307/452, 269, 594, 605

[56] References Cited

U.S. PATENT DOCUMENTS

| | | | |
|---|---|---|---|
| 3,619,097 | 11/1971 | Clay | 431/78 |
| 3,694,672 | 9/1972 | Buyak | 307/605 X |
| 4,243,372 | 1/1981 | Cade | 431/31 |

*Primary Examiner*—William E. Wayner

*Attorney, Agent, or Firm*—Alfred N. Feldman

[57] ABSTRACT

A timer and control circuit using a field effect transistor that is operated in three different current carrying conditions or operating modes is disclosed. The three operating modes are used to establish two successive timed intervals for a prepurge and a trial for ignition for a fuel burner.

8 Claims, 2 Drawing Figures

TIMER AND CONTROL CIRCUIT

BACKGROUND OF THE INVENTION

In the fuel burner control art it is normally necessary to sequence a blower supplying combustion air, the ignition source, and the main burner source of fuel in a prescribed series of timed intervals. This sequencing or programming can be accomplished by a number of different expedients.

In large fuel burner control systems the sequencing of the combustion air, ignition, and main burners is accomplished by programmers that have motor driven cam switches that operate in a timed sequence compatible with the particular burner. In smaller burners this can be accomplished by using electronic types of timing devices. Typically the electronic types of timing devices use a single timing circuit for each of the timed intervals required in the burner sequence. Typically, each timing interval will require an individual electronic timing circuit and these timing circuits will be sequenced so that a burner is properly operated. The more timing intervals required, obviously the more electronic components are required, and naturally the more expensive the device then becomes. A typical burner control device using electronic timing having a single safety interval is disclosed in U.S. Pat. No. 3,619,097 to Clay. In the Clay patent a pair of capacitors forming a voltage divider network provide a safety timing function and are used solely for that purpose. The additional functions required in the device require additional electronics in order to accomplish the programming and timing functions.

SUMMARY OF THE INVENTION

The present invention is directed to a type of timer and control circuit means that creates a timing sequence that has two well defined timing intervals. The timing sequence is accomplished by controlling a field effect transistor in a series of different modes of operation. This is an improvement over prior art timing devices, such as is disclosed in the above referenced Clay patent, where each timing interval required the use of separate electronic components such as field effect transistors or other solid state switches.

In the present invention the single field effect transistor is caused to operate in three different modes thereby creating two separate and distinct timing intervals. This arrangement is accomplished by a minimum of electronic components. The field effect transistor is caused to operate as a total impedance to current flow, as an impedance capable of conducting current in only one direction, and as a path capable of conducting current in both directions. By causing the field effect transistor to sequentially pass through this plurality of operating modes, prepurge and trial for ignition times are created for a combustion control.

DESCRIPTION OF THE PREFERRED EMBODIMENT

Figure 1:
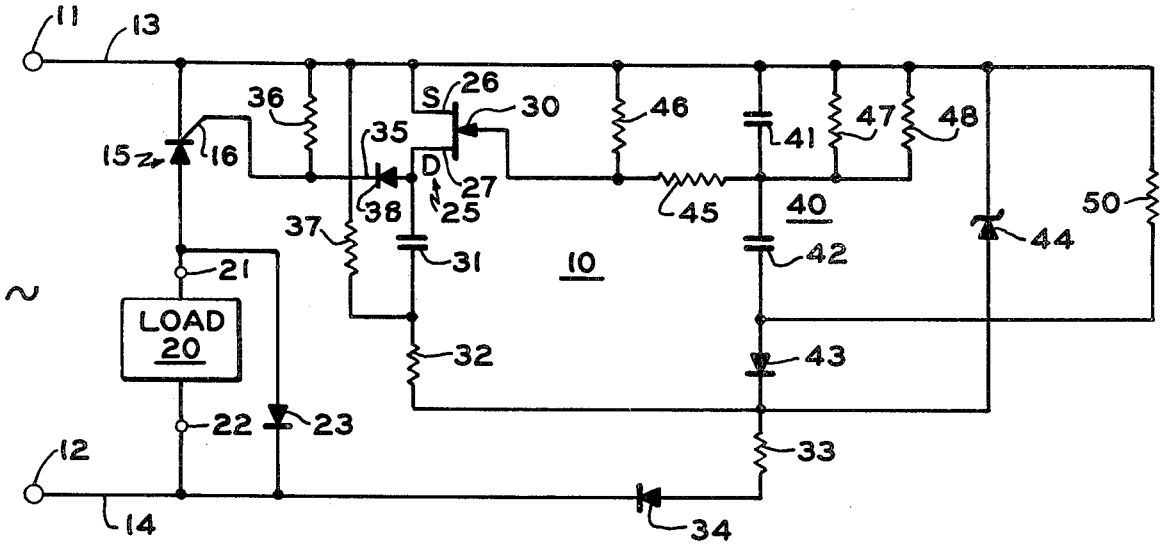
FIG. 1 is a schematic representation of the timer and control circuit means.

In FIG. 1 there is disclosed a timer and control circuit means generally indicated at 10 which is connected by terminals 11 and 12 to a conventional source of alternating current potential. Terminal 11 is connected to a conductor 13 that supplies one side of the control circuit means 10 with power, while terminal 12 is connected to a further conductor 14 that supplies the other side of the control circuit means 10 with power.

Connected between the conductors 13 and 14 is a silicon controlled rectifier generally disclosed at 15 and having a gate 16 for control of current through the silicon controlled rectifier 15. Connected in series with the silicon controlled rectifier 15 is a load means 20 that in turn is connected between a pair of terminals 21 and 22 so that the load means can be connected in a series circuit between the conductors 13 and 14 by the operation of the silicon controlled rectifier 15. Normally the load means 20 would be inductive in nature and in order to cause the load means 20 to operate properly a diode 23 is placed around the load means 20 and is poled oppositely to the silicon controlled rectifier 15. Load means 20 could be a fuel burner having a prepurge and a trial for ignition timing function, as will be brought out in connection with FIG. 2. Whenever current is drawn through the load means 20 from conductor 14 to conductor 13 thereby energizing the load means 20, the diode 23 is inactive. When the polarity of the potential applied to the conductors 13 and 14 reverses, and no current flows through the silicon controlled rectifier 15, the diode 23 allows for any inductive voltage in the load 20 to dissipate itself through the load and cause the load 20 to be energized in a consistent manner.

A field effect transistor generally disclosed at 25 is connected with a source connection 26 and a drain connection 27 to form a source-drain channel means that is controlled by a gate 30. The source 26 is connected directly to the conductor 13 while the drain 27 is connected to a capacitor 31 that further is connected in series with a pair of resistors 32 and 33 and a diode 34 to form a series circuit that connects the source-drain channel of the field effect transistor 25 across the source of voltage supplied to terminals 11 and 12.

The drain 27 is connected by a conductor 35 and a diode 38 to the gate 16 of the silicon controlled rectifier 15 so that the source-drain channel means of the field effect transistor 25 can control the conduction of current through the silicon controlled rectifier 15. The gate 16 is further connected to a resistor 36 that is connected in parallel with the source-drain channel means of the field effect transistor 25 to complete the gating circuit for the silicon controlled rectifier 15. A resistor 37 provides a discharge path for capacitor 31 through the gate 16 of the silicon controlled rectifier 15.

A capacitor voltage divider means is generally disclosed at 40 and includes a pair of capacitors 41 and 42 connected in a series circuit through a diode 43. The capacitor voltage divider means 40 is connected through the resistor 33 and the diode 34 to the conductor 14 so that the capacitor voltage divider means 40 is connected to the source of voltage and it is obvious that whenever the conductor 13 is positive with respect to conductor 14 that the voltage divider means 40 allows for the charge of the capacitors 41 and 42, but is blocked from further action on a reversal of the applied alternating current voltage by the diodes 34 and 43. The voltage divider means 40 is paralleled by a voltage regulating means or zener diode 44 so that the voltage across the capacitors 41 and 42 can be regulated.

The present circuit is completed by the addition of impedance means in the form of resistors that provide a discharge path for the capacitor 41. A resistor 45 is connected in series with a further resistor 46 with this pair of resistors connected to the opposite sides of the capacitor 41. The resistor 46 is of a very large value compared to the resistance value of the resistor 45. Two further resistors 47 and 48 are connected in parallel and across the capacitor 41 as a safety means to ensure that the capacitor 41 will eventually become discharged if the resistors elsewhere in the circuit inadvertently become open circuited. A further resistor 50 is provided as a discharge path for the capacitor voltage divider means 40.

Figure 2:
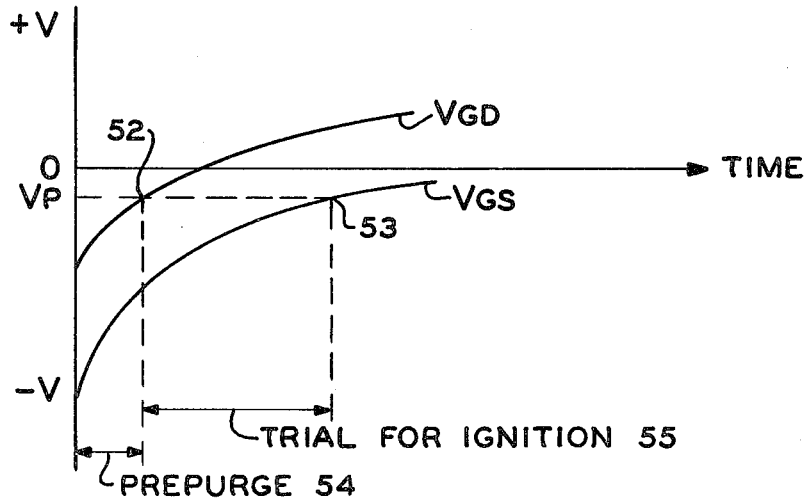
FIG. 2 is a voltage versus time graph for the operation of the field effect transistor.

The operation of the circuit of FIG. 1 can best be understood when considering a graph of the voltage applied to the field effect transistor 25. In FIG. 2 the operating conditions of the field effect transistor 25 are shown in a voltage versus time graph. Positive and negative voltages applied to the field effect transistor 25 are disclosed along with a voltage $V_P$ which is the pinch off voltage for current flow in the source-drain channel means of the field effect transistor 25 as controlled at the gate 30. The curve $V_{GD}$ is the curve of the effect of the gate to drain voltage of the field effect transistor 25 while the curve $V_{GS}$ is the curve of the voltage between the gate and the source of the field effect transistor 25. It will be noted that each of these curves intersects the pinch off voltage $V_P$ at 52 and 53 respectively. The intersection 52 designates a prepurge timing interval 54, while the time interval between 52 and the point 53 is a trial for ignition interval 55. The manner in which these intervals are accomplished will now be described.

OPERATION

The sequence of operation of the circuit of FIG. 1 can best be understood when considering both the circuit diagram and the graph of FIG. 2. If an alternating current voltage source is applied at the input terminals 11 and 12, the capacitors 41 and 42 each charge to one half of the zener voltage controlled by the zener diode 44. This is when the terminal 11 is positive with respect to terminal 12 so that current can be drawn through the diodes 43 and 34. Because the resistor 45 is much smaller than the resistance 46, the capacitor 41 will provide a voltage which appears between the gate 30 of the field effect transistor 25 and the source 26.

Initially no current can flow through the field effect transistor 25. On positive half cycles of the input wave, that is when terminal 11 is positive with respect to terminal 12, the field effect transistor 25 is pinched off because the resistance 37 and the resistance 32 voltage divider maintains a negative $V_{GD}$ on the field effect transistor 25. On the negative half cycles of the input wave form, the field effect transistor 25 is pinched off because the capacitor 41 maintains a negative $V_{GS}$ voltage on the field effect transistor 25.

As time progresses, the capacitor 41 loses charge through the network of resistors 45, 46, 47, and 48. The $V_{GD}$ voltage on the field effect transistor 25 is no longer sufficient to keep the field effect transistor off during the positive half cycles of the input wave. The capacitor 31 will now charge through the field effect transistor 25. Since the $V_{GS}$ voltage on the field effect transistor 25 is still adequate to keep the field effect transistor 25 pinched off on negative half cycles of the applied wave form, the capacitor 31 discharges through the silicon controlled rectifier 15 by providing a current path through diode 38 (which prevents capacitor 31 from charging through resistor 36), the gate 16 of the silicon controlled rectifier 15, and back through the resistor 37. This action turns the silicon controlled rectifier 15 on and allows a current flow from the conductor 14 to the conductor 13. This signifies the end of the prepurge period 54 and agrees with the point 52 of FIG. 2.

The capacitor 41 continues to discharge through the resistors 45, 46, 47, and 48 until the $V_{GS}$ voltage on the field effect transistor 25 is not adequate to keep the field effect transistor 25 pinched off during the negative half cycles of the input wave form. Now the field effect transistor 25 is on in both directions of current flow in the source-drain channel means. The capacitor 31 both charges and discharges through the field effect transistor 25. This then turns the silicon controlled rectifier 25 off, and signifies the end of the trial for ignition period 55 as is identified at point 53 in FIG. 2.

The present invention, as exemplified by the schematic in FIG. 1, allows for operating the field effect transistor 25 in effectively three different modes or current conducting states. The first is wherein the field effect transistor 25 is incapable of conducting through its source-drain channel means in either direction and this condition is used to create the prepurge period 54. After the voltage on the gate 30, as supplied by the capacitor 41, is bled down by a resistive or impedance network the field effect transistor 25 is allowed to operate as a conductor in one direction through the source-drain channel means thereby allowing the capacitor 31 to charge. The charge on capacitor 31 is used as a timing means to create a second timing interval or the trial for ignition interval 55. When the voltage on the gate 30 of the field effect transistor 25 is depleted so that it operates in its third mode, that is as a conductor in both directions through the source-drain channel means, the capacitor 31 is no longer able to keep the silicon controlled rectifier 15 in conduction and its termination ends the trial for ignition period 55. The simple expedient of adding the impedance or resistance means 37 to the circuit accomplishes the second function, and provides for a highly simplified dual function from a circuit which in previous applications has been capable of only providing a single function.

The applicant has disclosed in great detail a circuit capable of providing a timing and control function, and particularly a timing and control function for a fuel burner wherein a prepurge and a trial for ignition time period is established by the circuit operation. The circuit is subject to a number of obvious variations and as such the applicant wishes to be limited in the scope of his invention solely by the scope of the appended claims.

The embodiments of the invention in which an exclusive property or right is claimed are defined as follows:

1. A timer and control circuit having a timing sequence with two timing intervals established by creating a plurality of operating modes for a field effect transistor with said circuit adapted to control load means, including: silicon controlled rectifier means having gate means with said silicon controlled rectifier adapted to connect said load means to a source of alternating current voltage; a field effect transistor having a source-drain channel means and a control gate with said source-drain channel means connected to said silicon controlled rectifier gate means to control the conduction of current through said silicon controlled rectifier means and said load means; said source-drain channel means further connected in a series circuit with a capacitor, a diode, and impedance means with said series circuit connected across said source of voltage; resistance means connected in parallel circuit with a series combination of said source-drain channel means and said capacitor; capacitor voltage divider means connected to said source of voltage and initially charged upon application of said source of voltage to said timer and control circuit; said capacitor voltage divider means connected to said field effect transistor control gate to bias said field effect transistor to establish said plurality of operating modes for said field effect transistor; and bleeder impedance means connected to said capacitor voltage divider means to bleed off said initial charge from said capacitor voltage divider means to cause said field effect transistor to sequentially pass through said plurality of operating modes.

2. A timer and control circuit as described in claim 1 wherein said capacitor voltage divider means includes two capacitors connected in series circuit with a diode.

3. A timer and control circuit as described in claim 2 wherein said two capacitors and said series diode are connected in parallel circuit with voltage regulating means to stabilize the charge on said two capacitors.

4. A timer and control circuit as described in claim 3 wherein said voltage regulating means is a zener diode.

5. A timer and control circuit as described in claim 4 wherein said bleeder impedance means includes a plurality of timing resistors.

6. A timer and control circuit as described in claim 5 wherein said load means is a fuel burner with said fuel burner having a prepurge and a trial for ignition operating sequence controlled by said two timing intervals.

7. A timer and control circuit as described in claim 5 wherein said two capacitors are of substantially equal capacitance values.

8. A timer and control circuit as described in claim 6 wherein said two capacitors are of substantially equal capacitance values.

* * * * *